US005984719A

United States Patent [19]

Flegel

[11] Patent Number: 5,984,719

[45] Date of Patent: Nov. 16, 1999

[54] REMOTE POWER INLET BOX FOR AN AUXILIARY POWER SUPPLY SYSTEM

[75] Inventor: David D. Flegel, Racine, Wis.

[73] Assignee: Reliance Controls Corporation, Racine, Wis.

[21] Appl. No.: 09/002,229

[22] Filed: Dec. 31, 1997

[51] Int. Cl.[6] ..... H01R 13/60

[52] U.S. Cl. ..... 439/528; 439/535

[58] Field of Search ..... 439/304, 535, 439/528, 142; 174/66, 67, 47, 48, 53, 58, 59; 220/3.5, 3.6, 3.94, 3.2

[56] References Cited

U.S. PATENT DOCUMENTS

| | | | |
|---|---|---|---|
| 3,277,251 | 10/1966 | Daly | 200/50 |
| 3,284,591 | 11/1966 | Daly | 200/50 |
| 3,391,374 | 7/1968 | Schleicher | 339/14 |
| 3,523,166 | 8/1970 | Daly | 200/50 |
| 3,559,148 | 1/1971 | Hafer | 339/22 |
| 3,636,237 | 1/1972 | Hafer | 174/68 |
| 3,716,683 | 2/1973 | Hafer | 200/50 |
| 3,723,942 | 3/1973 | Dennison | 339/14 |
| 3,731,226 | 5/1973 | Hafer | 339/22 |
| 3,739,331 | 6/1973 | Murphy et al. | 339/103 |
| 3,742,431 | 6/1973 | Kobyner | 339/272 |
| 3,781,765 | 12/1973 | Schleicher | 339/103 |
| 3,922,053 | 11/1975 | Hafer | 339/22 |
| 4,058,358 | 11/1977 | Carlisle | 439/142 |
| 4,067,529 | 1/1978 | Milcoy | 248/221 |
| 4,088,829 | 5/1978 | Milcoy | 174/53 |
| 4,669,281 | 6/1987 | Young | 439/304 |

*Primary Examiner*—Michael L. Gellner
*Assistant Examiner*—Antoine Ngandjui
*Attorney, Agent, or Firm*—Andrus, Sceales. Starke & Sawall

[57] ABSTRACT

A power inlet box for use in a system for interconnecting a power generator to the electrical system of a building. The power inlet box is electrically interconnected with the main electrical panel of the electrical system, such as through a transfer panel and appropriate wiring, cables and fittings. The power inlet box includes a base member or housing for mounting to the exterior of a building and which defines an internal cavity. The base member includes a front, outwardly facing opening and a top, upwardly facing opening, each of which provides access to the internal cavity of the base member. The power inlet box further includes a cover member adapted for engagement with the base member. The cover member includes a front wall which engages and overlies the base member to enclose the base member front opening. The cover member further includes a top wall extending rearwardly from the front wall and which overlies the base member upwardly facing opening. A socket assembly is interconnected with the cover member, and includes a power inlet for receiving a connector at the end of a cord for providing power to the building electrical system from the auxiliary generator, through the transfer panel. Flanges extend from the edges of the cover member front and top walls, for overlapping the ends of the base member walls to provide a shingle construction preventing ingress of water into the base member internal cavity. The provision of openings in the base member providing access to the internal cavity in two different directions facilitates manipulation of wires connected to the socket for placement within the internal cavity when the cover member is being moved toward the base member for mounting. Further, the provision of separate front and top walls on the cover member functions to provide a highly effective arrangement for preventing ingress of water into the internal cavity through the joint between the cover member and the base member.

29 Claims, 4 Drawing Sheets

REMOTE POWER INLET BOX FOR AN AUXILIARY POWER SUPPLY SYSTEM

BACKGROUND AND SUMMARY OF THE INVENTION

This invention relates to a system for providing auxiliary power to the electrical system of a building in the event of a power outage or the like, and more particularly to a power inlet box for use in such a system.

In an auxiliary power supply system, a remote power generator is interconnected with a power inlet box which is typically mounted to the exterior of a building. The power inlet box is in turn interconnected with a manual transfer switching arrangement, which is connected to the main electrical panel or load center of the building. A cord is interconnected with the power outlet of the generator and with a power inlet receptacle associated with the power inlet box, for providing power from the generator through the power inlet box to the manual transfer panel and ultimately to the main electrical panel, in order to supply power to certain circuits of the building in the event of a power outage or the like.

Prior art power inlet boxes are in the form of a rectangular base member or housing having a back wall, a pair of side walls and top and bottom end walls, which together cooperate to define an internal cavity with a front, outwardly facing opening facing away from the building. The power inlet box includes a series of access openings which can be selectively opened and closed, and which may be threaded in order to receive a conduit nipple or the like. Wiring extends through the conduit nipple and the selected access opening into the interior of the housing. The power inlet box further includes a cover which is positionable over the front opening of the housing and engageable with the outer edges of the side walls and the top and bottom end walls. A power receptacle socket is mounted to the cover. The wiring must be pulled out of the housing and connected to terminals at the rear of the socket, and then "stuffed" back into the internal cavity defined by the housing as the cover is moved toward and into engagement with the outer edges of the housing walls. The orientation of the opening providing access to the internal cavity, i.e. outwardly facing in one direction only, makes it difficult to manipulate the wiring behind the cover as it is advanced toward the housing in this manner.

Further, the prior art construction contemplates a peripheral joint between the cover and the outer edges of the housing walls, which lies in a single, vertical plane. The upper edge of the joint faces upwardly, and is directly exposed to precipitation or other moisture in the air. A resilient gasket is interposed between the cover and the outer edges of the housing walls to assist in providing a weather tight seal between the cover and the housing. However, the gasket provides an opportunity for failure due to omission, improper installation or manufacture, or deterioration over time which can lead to ingress of water into the internal cavity of the housing.

It is an object of the present invention to provide a power inlet box structure having an improved construction which facilitates engagement of the cover with the base member or housing of the box, which is stationarily mounted to the exterior of the building. Another object of the invention is to provide a power inlet box which increases the size and alters the configuration of the opening providing access to the internal cavity of the housing, to make it easier for an installer to manipulate the wiring connected to the socket when engaging the cover with the housing or base member. It is a further object of the invention to provide a housing and cover construction in which the joint or interface between the housing and the cover is protected and not directly exposed to the elements.

In accordance with one aspect of the invention, a power inlet box for use in connecting an auxiliary power generator to the electrical system of a building includes a housing or base member defining an internal cavity and adapted for mounting to the exterior of a building, in combination with a cover member adapted for removable interconnection with the base member for enclosing the internal cavity. A power inlet is mounted to the cover member such that the cover member and the inlet are removable as a unit from the base member. The base member and cover member include engagement structure providing engagement of the cover member with the base member via combination movement of the cover member in a first direction toward the base member and in a second direction transverse to the first direction. The base member defines an opening providing access to the internal cavity. The combination motion employed in engaging the cover member with the base member facilitates manipulation of wiring located within the internal cavity and connected to the power receptacle during engagement of the cover member with the base member. The base member preferably includes a first, outwardly facing opening and a second opening facing in a direction transverse to that of the first opening, and each opening communicates with and provides access to the internal cavity. The base member engagement structure includes a pair of spaced walls which in part define the internal cavity and the first and second openings. The cover member preferably includes a first wall which engages the pair of spaced walls to enclose the first opening, and a second wall which engages the pair of spaced walls for enclosing the second opening. In a preferred form, the first opening faces outwardly and the second opening faces upwardly. In this form, the cover member first wall is in the form of a front wall and the cover member second wall is in the form of a top wall extending rearwardly from an upper end defined by the front wall. The power inlet is preferably mounted to the front wall, extending rearwardly therefrom. Flange structure is preferably provided on the first and second walls for overlying outer edge portions defined by the base member wall structure for preventing ingress of moisture into the internal cavity and for eliminating the need for a gasket between the base member and the cover member. The base member further includes a bottom wall defining the lower extent of the internal cavity, and the bottom wall extends between lower edge portions defined by the pair of spaced walls. The lower portion of the cover member front wall overlies an outer edge defined by the base member bottom wall, and a removable securing member, such as a threaded fastener, engages an opening formed in the front edge of the bottom wall and extends through an opening formed in the cover member front wall for removably securing the cover member to the base member. The power inlet includes socket structure which is located within an opening provided in the front wall, and a mounting arrangement for securing the socket structure to the front wall.

In accordance with another aspect of the invention, a power inlet box for use in connecting an auxiliary power generator to the electrical system of a building includes a base member defining an internal cavity and adapted for mounting to the exterior of the building, and a cover member adapted for removable interconnection with the base member for enclosing the internal cavity. A power inlet is mounted to the cover member and includes a mounting adaptor member positionable within an opening formed in the cover member, and power receptacle socket structure including a flange. The flange is positionable over at least a portion of the mounting adaptor member, and at least one fastener functions to secure the flange, as well as the portion of the mounting adaptor member over which the flange is positionable, to the cover member for securing both the socket structure and the mounting adaptor member to the cover member. The mounting adaptor member includes a peripheral wall and a shoulder located adjacent the peripheral wall and from which the peripheral wall extends. The socket structure flange is engageable with the shoulder inwardly of the peripheral wall, and the fastener extends through the shoulder and interconnects the flange with the cover member. An access cover is associated with the mounting adaptor member, and is movable between a closed position in which the access member engages the peripheral wall, and an open position providing access to the power inlet socket structure. In its closed position, the access cover prevents access to the socket structure and provides a weather tight enclosure for the socket structure. The access cover is preferably mounted for pivoting movement between its open and closed positions via a pivotable mounting arrangement interposed between the access cover and the peripheral wall.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
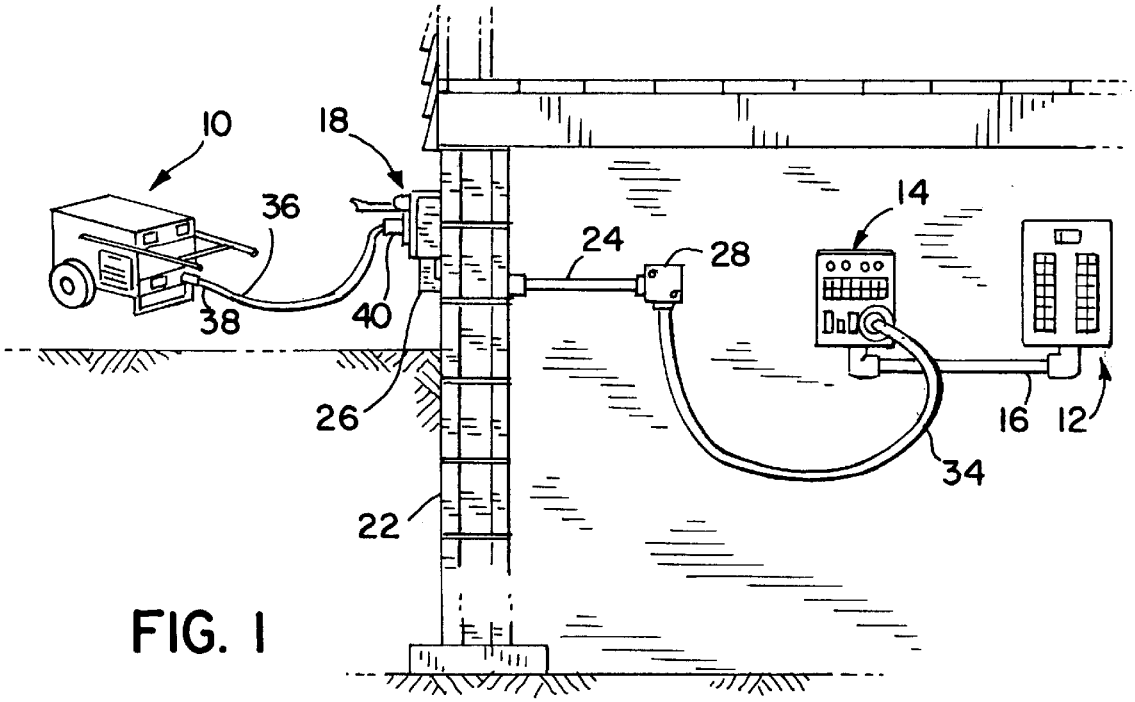
FIG. 1 is a partial section view of a building showing interconnection of a remote power generator with the main electrical panel of the building.

FIG. 1 illustrates a system for interconnecting a remote power generator 10 with the main electrical distribution panel or load center 12 of a building. A manual transfer panel 14 is mounted to the building interior wall adjacent main panel 12, and is connected to main panel 12 via wiring disposed within a conduit 16 extending therebetween. Manual transfer panel 14 may be that such as is manufactured by Reliance Time Controls, Inc. of Racine, Wis. under the designation GEN/TRAN (e.g. model 20216 or any other satisfactory model).

A power inlet box 18 is mounted to the exterior of a building wall, shown at 22. A conduit 24 extends from the interior of building wall 22, and is interconnected with power inlet box 18 via any satisfactory, conventional wire routing structure, such as an elbow 26 and an nipple extending therefrom and through wall 22 for interconnection with conduit 24. A junction box 28 is mounted to the interior wall of the building, and a flexible cord 34 is attached to junction box 28. Flexible cord 34 has a plug which is engageable with a power inlet receptacle provided on transfer panel 14, to complete the electrical connection between power inlet box 18 and manual transfer panel 14 for supplying power to main panel 12 in the event of a power outage or the like.

A flexible cord 36 includes a plug 38 at one end which is engageable with the power outlet of generator 10. At its opposite end, cord 36 includes a connector 40 engageable with power inlet box 18 in a manner to be explained, for supplying power to power inlet box 18 from generator 10. When cord 36 is installed in this manner, auxiliary power supplied by generator 10 is transferred to manual transfer panel 14 through inlet box 18 and the wiring in elbow 26, conduit 24, junction box 28 and cord 34 to transfer panel 14. The wiring in conduit 16 transfers power to selected circuits of main panel 12 according to the position of certain switches on transfer panel 14, so as to provide power to such circuits in the event of a power outage.

Figure 2:
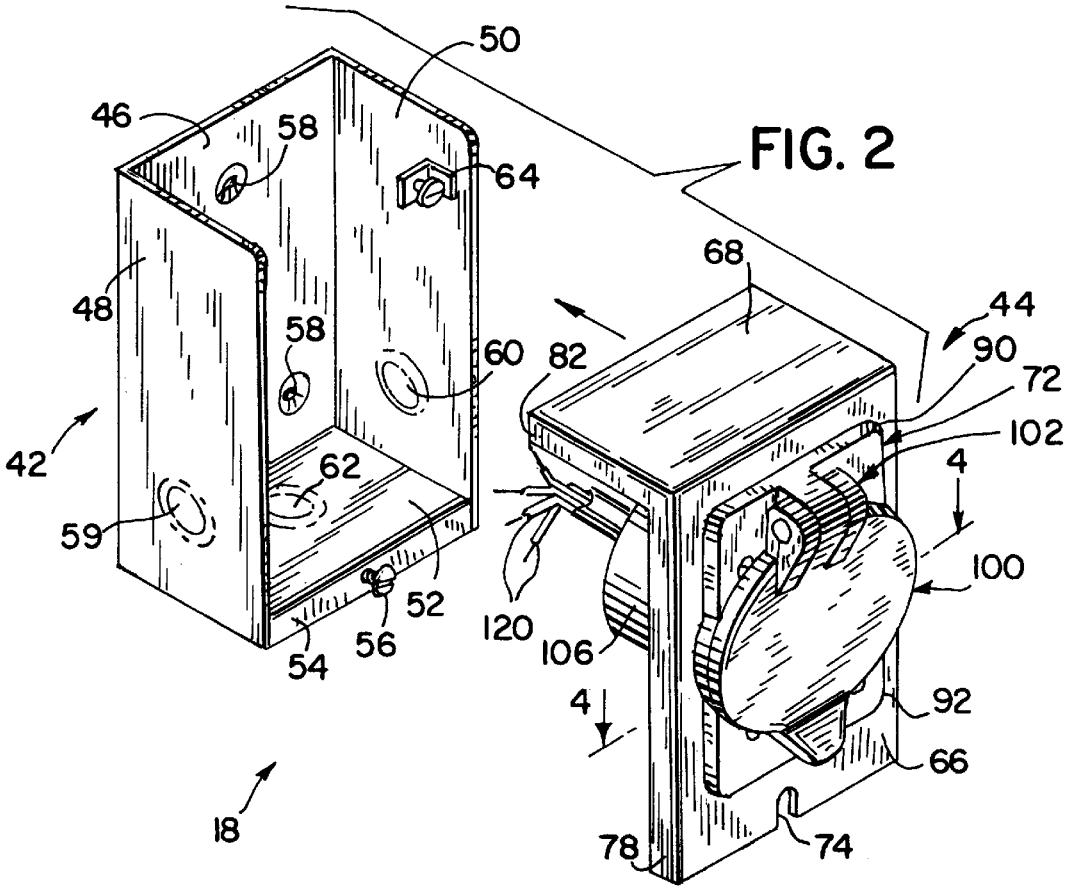
FIG. 2 is an exploded isometric showing the power inlet box of the invention, which is incorporated into the generator connection system of FIG. 1.

As shown in FIG. 2, power inlet box 18 generally includes a housing or base member 42 and a cover assembly 44. Base member 42 includes a rear wall 46 and a pair of side walls 48, 50 extending forwardly from the sides of rear wall 46. A bottom wall 52 extends forwardly from the lower end of rear wall 46, and extends between the lower ends of side walls 48, 50. Bottom wall 52 defines a flange 54 at its outer end. An opening is formed in the center of flange 54, and a threaded fastener 56, such as a screw, is threadedly engageable with the opening in flange 54.

A series of openings 58 are formed in rear wall 46, for use in mounting base member 42 to wall 22. Side walls 48, 50 include knock out sections 59, 60, respectively, and bottom wall 52 includes a knock out section 62. Similarly, rear wall 46 includes a knock out section (not shown) like knock out sections 59, 60 and 62, in a manner as is known. A ground terminal 64 is mounted to sidewall 50.

Figure 3:
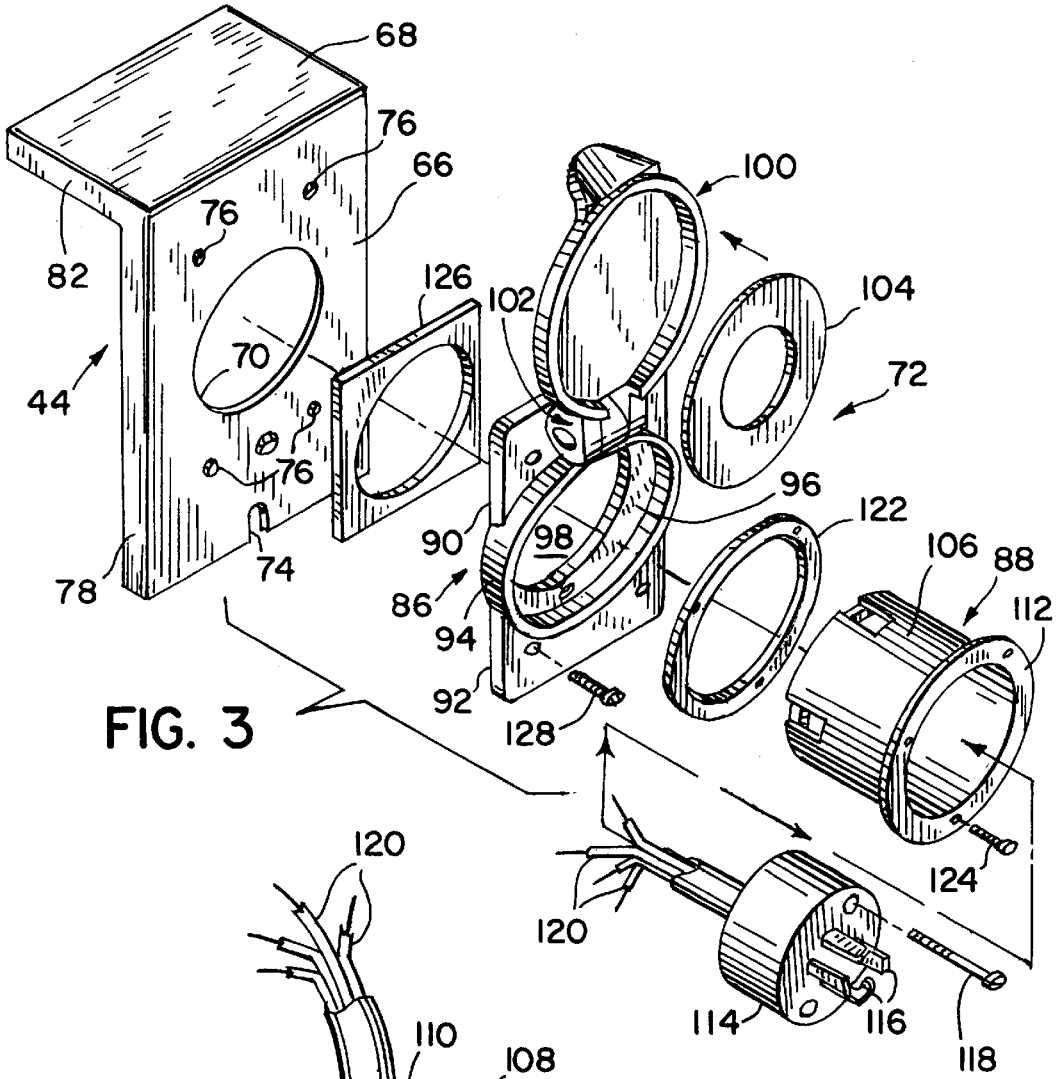
FIG. 3 is an exploded isometric view of the cover member and power receptacle socket structure for the power inlet box of FIG. 2.

Referring to FIGS. 2 and 3, cover assembly 44 includes a front wall 66 and a top wall 68 extending rearwardly from the upper end of front wall 66. Front wall 66 includes a central opening 70. A power inlet in the form of a power receptacle socket assembly shown generally at 72, is mounted to front wall 66 and extends through opening 70. A slot 74 extends vertically upwardly from the lower edge of front wall 66. In addition, a series of holes 76 are formed in front wall 66, spaced outwardly from the edge of opening 70.

A pair of side flanges 78, 80 extend rearwardly from the side edges of front wall 66, throughout the height of front wall 66. Similarly, a pair of flanges, one of which is shown at 82, extend downwardly from the side edges of top wall 68 throughout the length of top wall 68. A flange similar to flange 82 extends downwardly from the rear edge of top wall 68 between the side flanges.

Figure 4:
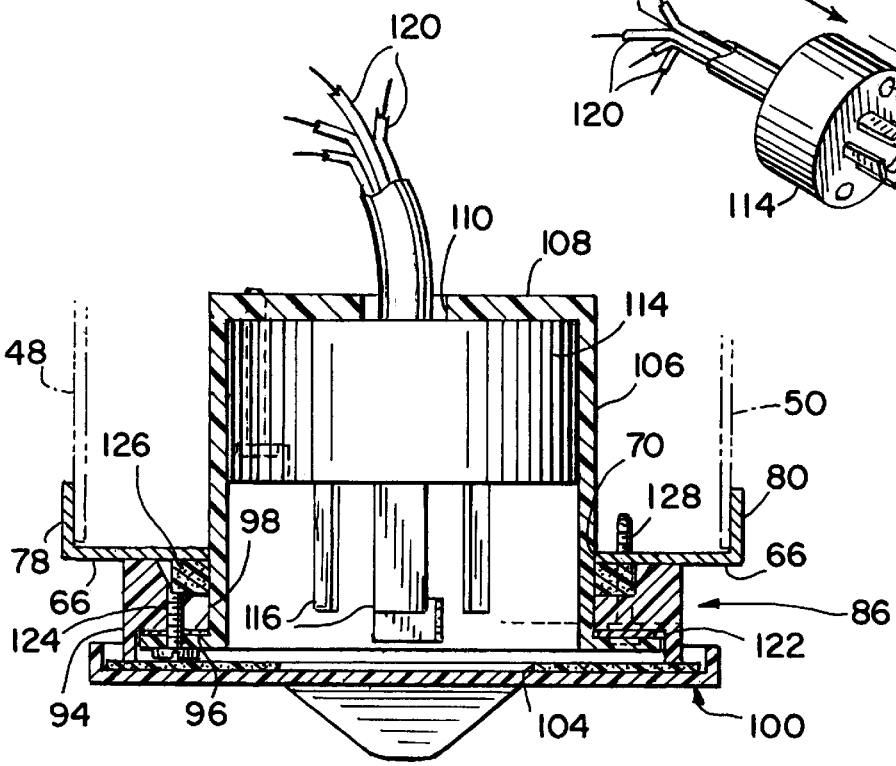
FIG. 4 is a section view taken along line 4—4 of FIG. 2.

Referring to FIGS. 3 and 4, socket assembly 72 includes a mounting member in the form of a socket base and a socket member 88. Socket base 86 includes plate-like upper and lower portions 90, 92, respectively, extending in opposite directions from a central ring defined by a peripheral upstanding wall 94. An annular flange or shoulder 96 extends inwardly from the inner surface of wall 94, defining a central opening 98.

An access cover 100 is interconnected with socket base 86 via a conventional hinge mounting arrangement, shown at 102. A sealing gasket 104 is mounted to the inside surface of access cover 100. In a manner as is known, cover 100 is pivotable via hinge arrangement 102 between an open position as shown, and a closed position in which cover 100 engages the outer edge of wall 94, such that access cover 100 overlies the area enclosed by wall 94. Hinge arrangement 102 includes a conventional pivot pin defining the pivot axis of cover 100, and a torsion spring for biasing cover 100 toward its closed position.

Socket member 88 includes a cylindrical side wall 106 terminating in an inner end wall 108 having a central opening 110. A flange 112 extends outwardly from the outer end of side wall 106.

A receptacle block 114 having a series of outwardly extending prongs 116 is mounted in the interior of socket member 88 via a pair of fasteners such as 118 which engage threaded openings formed in inner end wall 108. Receptacle block 114 includes terminals adapted to receive and electrically engage a series of wires, shown at 120, for conducting power to prongs 116 and for providing a ground connection for receptacle block 114, in a manner as is known.

In assembly, socket member 88 is mounted to socket base 86 by inserting socket member 88 through socket base opening 98. A gasket ring 122 is slipped over socket member side wall 106 into engagement with the rear side of flange 112, such that gasket ring 122 is disposed between flange 112 and annular shoulder 96. Screws such as 124 extend through openings formed in flange 112 and into aligned, threaded openings formed in shoulder 96, to securely mount socket member 88 to socket base 86. Gasket 122 is sandwiched between flange 112 and shoulder 96, to provide a water-tight seal therebetween.

When initially installing power inlet box 18 on wall 22, the installer secures power inlet box base member 42 to wall 22 and then engages a conduit fitting, such as 26, with base member 42 using one of knock-out sections 59, 60 or 62, as appropriate. Other conduits and fittings are installed as desired, and the installer then threads wiring such as 120 through the conduit fitting 26 and into the internal cavity of base member 42. Alternatively, wiring 120 can extend into the internal cavity of base member 42 through the knock out section in base member rear wall 46. The installer then draws the ends of wires 120 out of the internal cavity defined by base member 42, and threads the wires 120 through opening 110 in socket member 88 for connection to receptacle block 114. Receptacle block 114 is typically pre-mounted by the manufacturer in the interior of socket member 88 using screws 124, to complete assembly of socket assembly 72.

To facilitate on-site installation, socket assembly 72 is preferably fully assembled and mounted to cover member front wall 66 by the manufacturer, such that field installation simply entails connection of wires 120 to receptacle block 114. Socket assembly 72 is mounted to cover member front wall 66 by inserting socket member 88, which extends rearwardly from socket base 86, through opening 70 formed in cover member front wall 66 such that socket base 86 engages front wall 66. A gasket 126 is placed between socket base 86 and cover member front wall 66, to provide a water-tight seal preventing ingress of water through opening 70. Screws such as 128 engage holes 76 in front wall 66 and extend through aligned openings in upper and lower portions 90, 92 of socket base 86, and are tightened to securely mount socket base 86, and thereby socket assembly 72, to cover member front wall 66.

When socket assembly 72 is assembled in this manner and mounted to front wall 66 as shown in FIG. 2, with wires 120 mounted to receptacle block 114, cover member 44 is then engaged with base member 42 to complete assembly of inlet box 18. To engage cover member 44 with base member 42, the user first positions cover member 44 such that upper wall 68 is located above the upper ends of walls 46–50 and rear wall 46 is located outwardly of the outer ends of side walls 48, 50 and bottom wall 52. The user then moves cover member 44 laterally inwardly toward base member 42, such that cover member top wall 48 is located over the upwardly facing opening defined by the upper edges of side walls 48, 50 and rear wall 46. In this position, the rear flange which extends downwardly from the rear edge of top wall 68 is located rearwardly of base member rear wall 46. Prior to positioning of cover member 44 in this manner, the user has access to the internal cavity defined by base member 42 either through the upwardly facing opening defined by the upper edges of walls 46–50 or through the forwardly facing opening defined by the outer edges of walls 48, 50 and 52. When cover member 44 is positioned in this manner such that top wall 68 overlies the upwardly facing opening defined by base member 42, the user still has access to the internal cavity defined by base member 42 through the forwardly facing opening above bottom wall 52 and below the lower end of cover member front wall 66. This enables the user to relatively easily manipulate and position wires 120 within the internal cavity defined by base member 42. The user then moves cover member 44 downwardly relative to base member 42, such that the underside of top wall 68 engages the upper ends of the side walls 48, 50 and rear wall 46 to enclose the top opening of base member 42. In this position, the rear flange which extends downwardly from the rear edge of top wall 68 is located rearwardly of the upper end of rear wall 46, and likewise the side flanges, such as 82, which extend downwardly from the side edges of top wall 68 extend downwardly past the upper edges of base member side walls 48, 50. The depending top wall flanges thus overlap walls 46–50, to provide a shingle structure preventing ingress of water into the internal cavity of base member 42. Similarly, side flanges 78, 80 overlap the front edges of side walls 48, 50, to again prevent ingress of water into the internal cavity of base member 42 through the front opening of base member 42.

When cover member 44 is installed on base member 42 in this manner, slot 74 in the lower edge of cover member front wall 66 receives the shank of screw 56 mounted to base member bottom wall 52. To secure cover member 44 in position, the user tightens screw 56 such that its head engages cover member front wall 66 adjacent slot 74. In combination with the rear flange depending downwardly from the rearward edge of cover member top wall 68, this functions to securely mount cover member 44 to base member 42.

As can be appreciated, the provision of openings in base member 42 which face both outwardly and upwardly provides the dual function of facilitating handling of wires, such as 120, when mounting cover member 44 to base member 42, as well as providing a weather resistant structure for preventing water from entering the internal cavity by enclosing the base member upwardly facing opening with a top wall associated with the cover member.

Figure 5:
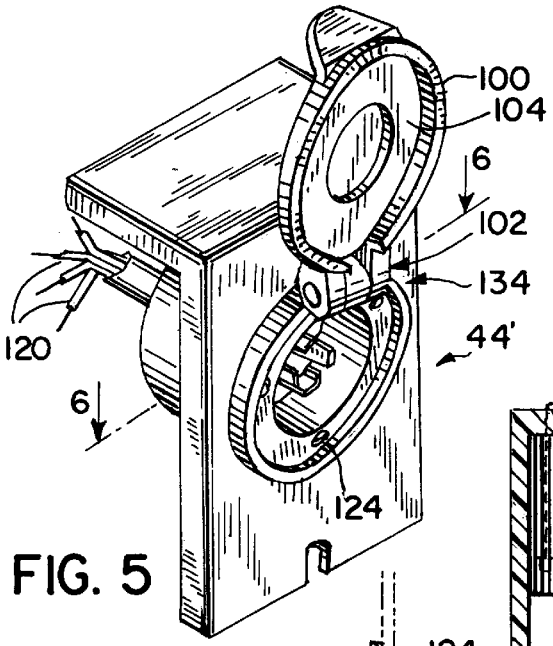
FIG. 5 is an isometric view of an alternative embodiment of the cover member for the power inlet box of FIG. 2.

FIG. 5 illustrates an alternative cover member, shown at 44', for use in place of cover member 44, and like reference characters will be used where possible to facilitate clarity. Cover member 44' includes a front wall 66 and a top wall 68 like cover member 44, with the only exception being the provision of holes 132 adjacent opening 70 in cover member 44' in place of holes 76 of cover member 44. In all other respects, front wall 66 and top wall 68 are the same for cover member 44' as for cover member 44, including the depending flanges such as 78, 80 and 82.

Cover member 44' includes power inlet in the form of a socket assembly 134 which has several components in common with socket assembly 72 of FIGS. 1–4, and again like reference characters will be used to facilitate clarity. Socket assembly 134 includes socket member 88, gasket ring 122 and receptacle block 114. In this embodiment, a mounting adaptor 136 is interposed between socket member 88 and front wall 66.

Mounting adaptor 136 includes a ring-shaped wall 138 having an annular shoulder 140 extending inwardly therefrom and terminating in an inwardly facing edge defining an opening 142. Spaced apertures 144 are formed in shoulder 140. Hinge arrangement 102 is mounted to wall 138, for pivotably mounting access cover 100 to wall 138. Gasket 104 is adapted for mounting to the inside of access cover 100.

Figure 6:
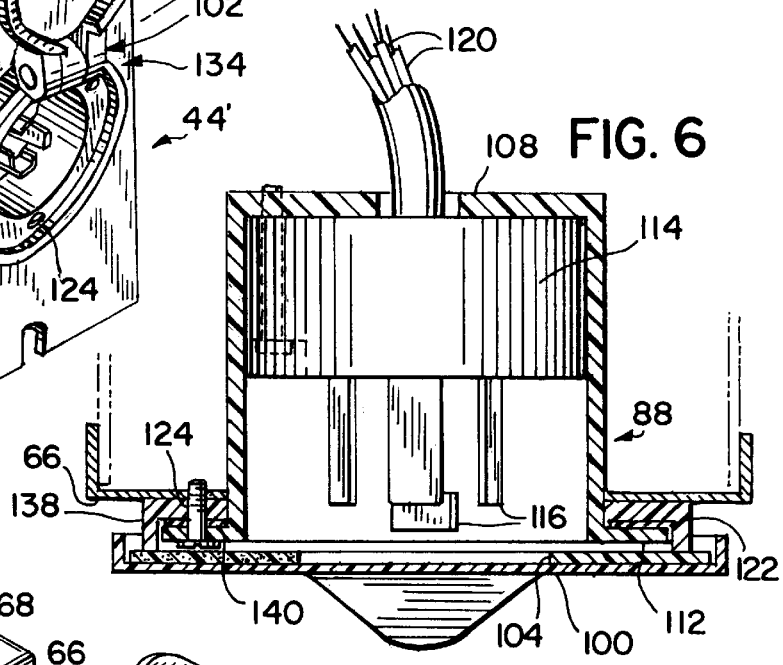
FIG. 6 is a section view taken along 6—6 of FIG. 5.
Figure 7:
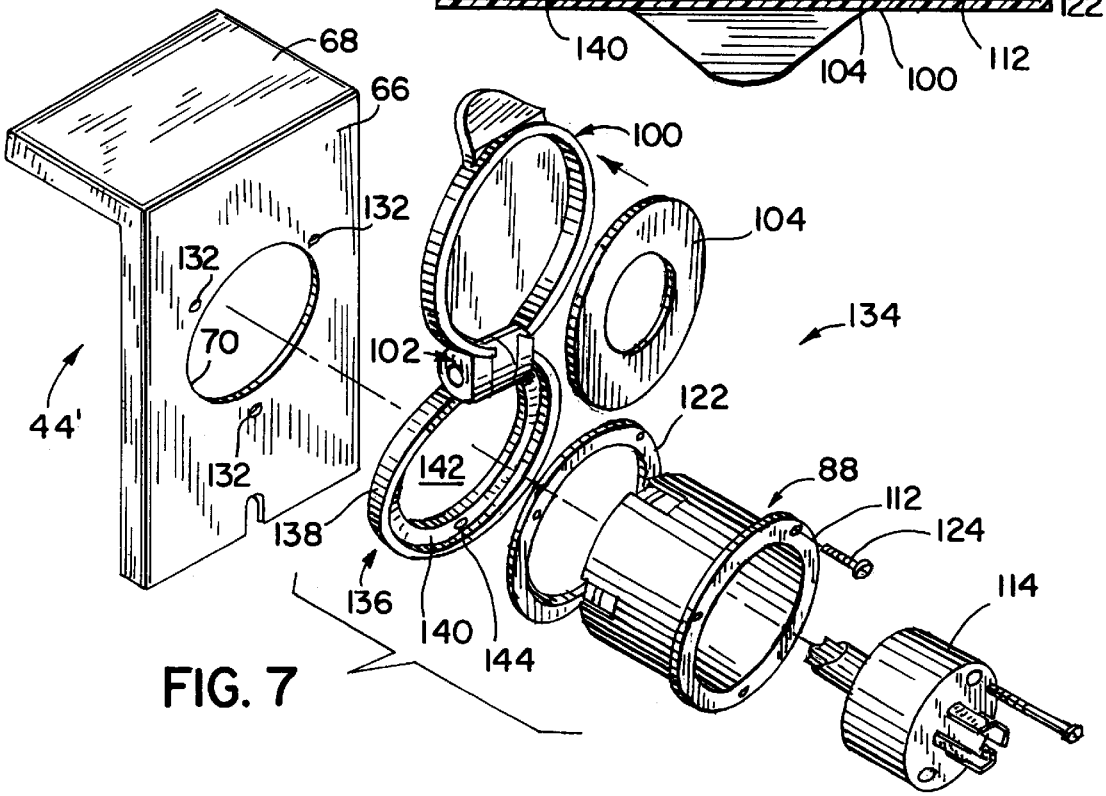
FIG. 7 is an exploded isometric view similar to FIG. 3, showing the components of the power receptacle socket structure of FIGS. 5 and 6.

To facilitate on-site installation, socket assembly 134 is again preferably fully assembly by the manufacturer and mounted to front wall 66. Receptacle block 114 is secured within the interior of socket member 88 using fasteners 118. Socket member 88 is engaged with front wall 66 such that the body of socket member 88 extends through gasket 122, mounting adaptor opening 142 and front wall opening 70. Gasket 122 is engaged with the rear surface of socket member flange 112, and is sandwiched between flange 112 and mounting adaptor shoulder 140. An additional gasket (not shown) may be placed between front wall 66 and the rearwardly facing surface of wall 138. Mounting adaptor 136 is engaged with the outer surface of front wall 66 over opening 70, and openings 144 in mounting adaptor shoulder 140 are aligned with holes 132 in cover member front wall 66. Fasteners 124 extend through aligned openings formed in socket member flange 112 and gasket 122, through apertures 144 in shoulder 140 and into threaded engagement with holes 132. In this manner, mounting adaptor 132 and socket member 88 are secured to front wall 66 as a unit. This eliminates the need for fasteners 128 in the embodiment of FIGS. 1–4, which function to secure socket base member 86 to front wall 66 separately from securement of socket member 88. The embodiment of FIGS. 5–7 provides a quick and easy method for mounting socket assembly 134 to cover member front wall 66.

At the time of installation, the user simply connects wire 120 to receptacle block 114 through mounting adaptor opening 142. Cover member 44' is then engaged with base member 42 in the same manner as described previously with respect to cover member 44.

Figure 8:
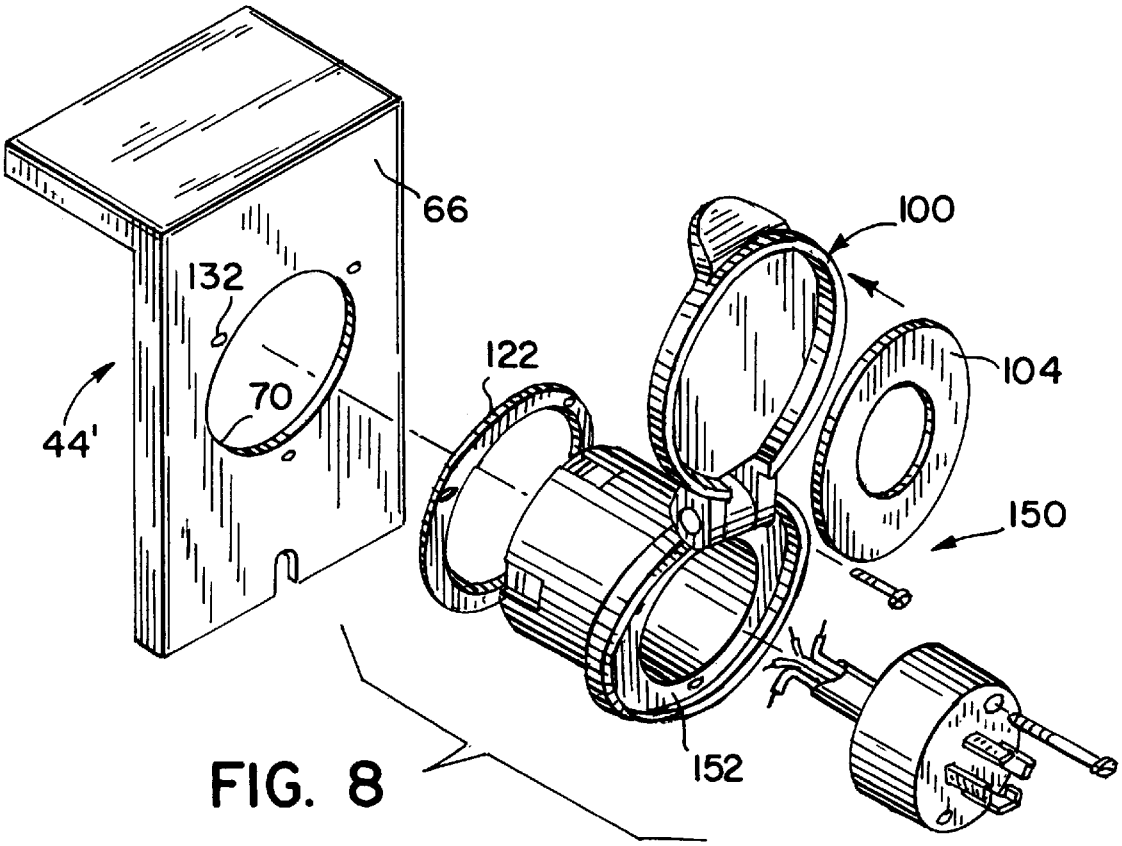
FIG. 8 is a view similar to FIG. 7, showing an alternative arrangement for the components of the power receptacle socket structure of FIG. 7.
Figure 9:
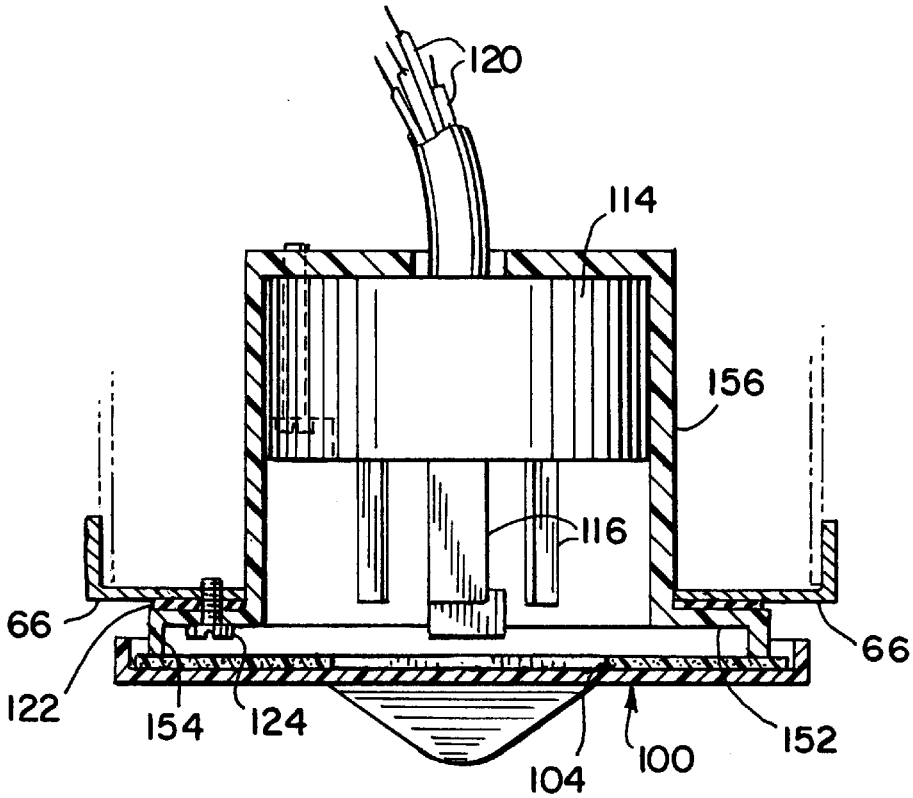
FIG. 9 is a view similar to FIG. 6 showing the components of the power receptacle socket structure of FIG. 8 as installed.

FIGS. 8 and 9 illustrate an alternative socket assembly, shown at 150, for use in combination with cover member 44'. Socket assembly 150 essentially consists of socket member 88 and mounting adaptor 136 of FIG. 7, formed integrally with each other. With this construction, socket member flange 112 and mounting adaptor shoulder 140 are combined into a single flange 152 having spaced apertures adapted for alignment with apertures 132 in front wall 66 of cover member 44'. An outwardly extending peripheral wall 154 extends from the outer edge of flange 152, and hinge arrangement 102 is interconnected with wall 154 and flange 152 for pivotably mounting access cover 100. Again, gasket 104 is adapted for engagement with the inside surface of access cover 100, which is pivotable about hinge arrangement 102 between an open position as shown in FIG. 8 and a closed position as shown in FIG. 9. A cylindrical socket member 156 extends rearwardly from the inner edge of flange 152, and has generally the same construction as socket member 88 of FIGS. 1–7. Receptacle block 114 is mounted to socket member 156 as shown and described above, including the connection of wires 120 to receptacle block 114.

In the embodiment of FIG. 9, gasket 122 is placed between the rearwardly facing surface of flange 152 and the forwardly facing surface of cover member front wall 66. Screws 124 extend through the spaced openings in flange 152 through aligned spaced openings in gasket 122, and into threaded engagement with openings 132 in cover member front wall 66 for securing socket assembly 150 to cover member 44'. As can be readily appreciated, this construction reduces the overall number of parts required for the socket assembly and simplifies mounting of the socket assembly to the cover member by reducing the overall number of parts required for manufacture and installation.

Various alternatives and embodiments are contemplated as being within the scope of the following claims particularly pointing out and distinctly claiming the subject matter regarded as the invention.

We claim:

1. A power inlet box for use in connecting an auxiliary power generator to the electrical system of a building, comprising:

a base member defining an internal cavity and adapted for mounting to the building;

a cover member adapted for removable interconnection with the base member for enclosing the internal cavity; and a power inlet mounted to the cover member such that the cover member and the inlet are removable as a unit from the base member;

wherein the base member and the cover member include engagement structure providing engagement of the cover member with the base member via combination movement of the cover member in a first direction toward the base member and in a second direction transverse to the first direction.

2. The power inlet box of claim 1, wherein the base member includes a first outwardly facing opening in communication with the internal cavity and a second opening in communication with the internal cavity and facing in a direction transverse to the first opening.

3. The power inlet box of claim 2, wherein the base member engagement structure includes wall structure defining the internal cavity and the first and second openings, and wherein the cover member engagement structure includes a first wall for enclosing the first opening and a second wall for enclosing the second opening, for covering and preventing access to the internal cavity through the first and second openings.

4. The power inlet box of claim 3, wherein the first opening faces outwardly and the second opening faces upwardly, wherein the first wall comprises a front wall to which the power inlet is mounted, and wherein the second wall comprises a top wall extending rearwardly from an upper end defined by the front wall.

5. The power inlet box of claim 3, further comprising flange structure provided on the first and second walls for overlying outer edge portions defined by the base member wall structure for preventing ingress of moisture into the internal cavity.

6. The power inlet box of claim 3, wherein the base member wall structure includes a bottom wall, wherein the base member first opening faces outwardly and the base member second opening faces upwardly opposite the bottom wall, and further comprising a removable securing member engageable with the bottom wall and with the base member first wall for removably securing the cover member to the base member.

7. The power inlet box of claim 3, wherein the first opening faces outwardly and wherein the first wall comprises a front wall provided on the cover member, and wherein the power inlet is mounted to the front wall.

8. The power inlet box of claim 7, wherein the power inlet includes socket structure located within an opening provided in the front wall, and a mounting arrangement for securing the socket structure to the front wall.

9. The power inlet box of claim 8, wherein the mounting arrangement comprises a base member adapted for mounting to the front wall and including an opening in alignment with the front wall opening, and wherein the socket structure includes a flange engageable with and secured to the base member.

10. The power inlet box of claim 8, wherein the mounting arrangement comprises a socket mounting member defining an opening in alignment with the front wall opening, and wherein the socket structure includes a flange engageable with the socket mounting member, and further comprising one or more fasteners extending between and interconnecting the flange and the front wall for securing the socket structure and the socket mounting member to the front wall.

11. A power inlet box for use in connecting an auxiliary power generator to the electrical system of a building, comprising:

a base member having wall structure which defines an open top and an open front;

a cover member connectable to the base member and including wall structure configured to enclose the open top of the base member and the open front of the base member, and wherein the cover member is removable from the base member to provide access to the open top and open front of the base member;

a power inlet member mounted to the cover member such that the cover member and the power inlet member are removable as a unit from the base member; and wherein the base member and the cover member include engagement structure providing engagement of the cover member with the base member via combination movement of the cover member in a first direction toward the base member and in a second direction transverse to the first direction.

12. The power inlet box of claim 11, wherein the base member includes a bottom wall located opposite the open top, and further comprising a removable securing member engageable with the cover member wall structure and the base member bottom wall for removably mounting the cover member to the base member.

13. The power inlet box of claim 11, wherein the cover member includes a front wall and a top wall, each of which include flange structure for overlying outer edge portions defined by the base member wall structure adjacent the open front and open top, respectively, defined by the base member.

14. The power inlet box of claim 13, wherein the open front is defined by outer edge portions of a pair of spaced side walls and wherein the open top is defined by upper edge portions of the pair of spaced side walls, and wherein the cover member flange structure includes a pair of depending flanges on the cover member top wall, each of which extends over an upper edge portion of one of the side walls, and a pair of rearwardly extending flanges on a front wall defined by the cover member wall structure, each of which extends over an outer edge portion of one of the side walls.

15. The power inlet box of claim 11, wherein the power inlet comprises socket structure extending through an opening formed in the cover member wall structure.

16. The power inlet box of claim 15, wherein the socket structure is mounted to a front wall defined by the cover member wall structure via a socket mounting member interposed between and connected to the socket structure and the cover member front wall.

17. The power inlet box of claim 16, wherein the socket mounting member includes a cover movable between an open position providing access to the power inlet and a closed position preventing access thereto.

18. A power inlet box for use in connecting an auxiliary power generator to the electrical system of a building, comprising:

a base member having wall structure which defines an open top and an open front;

a cover member connectable to the base member and including wall structure configured to enclose the open top of the base member and the open front of the base member, and wherein the cover member is removable from the base member to provide access to the open top and open front of the base member, wherein the cover member includes a front wall and a top wall which include flange structure for overlying outer edge portions defined by the base member wall structure adjacent the open front and open top, respectively, defined by the base member; and a power inlet member mounted to the cover member.

19. The power inlet box of claim 18, wherein the front opening is defined by outer edge portions of a pair of spaced side walls and wherein the top opening is defined by upper edge portions of the pair of spaced side walls, and wherein the cover member flange structure includes a pair of depending flanges on the cover member top wall, each of which extends over an upper edge portion of one of the side walls, and a pair of rearwardly extending flanges on the cover member front wall, each of which extends over an outer edge portion of one of the side walls.

20. A power inlet box for use in connecting an auxiliary power generator to the electrical system of a building, comprising:

a base member having wall structure which defines an open top and an open front, wherein the base member includes a bottom wall located opposite the open top;

a cover member connectable to the base member and including wall structure configured to enclose the open top of the base member and the open front of the base member, and wherein the cover member is removable from the base member to provide access to the open top and open front of the base member;

a power inlet member mounted to the cover member: and a removable securing member engageable with the wall structure of the cover member and the base member bottom wall for removably mounting the cover member to the base member.

21. A power inlet box for use in connecting an auxiliary power generator to the electrical system of a building, comprising:

a base member having wall structure which defines an open top and an open front;

a cover member connectable to the base member and including wall structure configured to enclose the open top of the base member and the open front of the base member, and wherein the cover member is removable from the base member to provide access to the open top and open front of the base member; and a power inlet member mounted to the cover member, wherein the power inlet member comprises socket structure extending through an opening formed in the cover member front wall.

22. The power inlet box of claim 21, wherein the socket structure is mounted to the cover member front wall via a socket mounting member interposed between and connected to the socket structure and the cover member front wall.

23. The power inlet box of claim 22, wherein the socket mounting member includes a cover movable between an open position providing access to the power inlet and a closed position preventing access thereto.

24. A power inlet box for use in connecting an auxiliary power generator to the electrical system of a building, comprising:

a base member defining an internal cavity and adapted for mounting to the building, wherein the base member includes a pair of side walls defining a top opening and a front opening, each of which is in communication with the internal cavity;

a cover member adapted for removable interconnection with the base member for enclosing the internal cavity, wherein the cover member includes a top wall and a front wall, wherein the top wall encloses the top opening of the base member and the front wall encloses the front opening of the base member when the cover member is interconnected with the base member; and a power inlet mounted to the cover member including power inlet socket structure and a mounting member engageable with the cover member, and at least one fastener securing the mounting member to the cover member.

25. The power inlet box of claim 24, wherein the power inlet is mounted to the front wall of the cover member.

26. The power inlet box of claim 25, wherein the base member further includes a bottom wall extending between and interconnecting the pair of side walls, and further comprising a removable securing member extending between the cover member front wall and the base member bottom wall for removably securing the cover member to the base member.

27. A power inlet box for use in connecting an auxiliary power generator to the electrical system of a building, comprising:

a base member defining an internal cavity and adapted for mounting to the building;

a cover member adapted for removable interconnection with the base member for enclosing the internal cavity; and a power inlet mounted to the cover member including power inlet socket structure and a mounting member engageable with the cover member, and at least one fastener securing the mounting member to the cover member, wherein the mounting member includes a peripheral wall and a shoulder located adjacent the peripheral wall, wherein the peripheral wall extends from the shoulder, and wherein the power inlet socket structure includes a flange engageable with the shoulder inwardly of the peripheral wall such that the at least one fastener extends through the shoulder and the flange and into engagement with the cover member.

28. The power inlet box of claim 27, further comprising an access cover associated with the mounting member, wherein the access cover is movable between a closed position in which the access cover engages the peripheral wall to prevent access to the power inlet socket structure, and an open position providing access to the power inlet socket structure.

29. The power inlet box of claim 28, wherein the access cover is mounted for pivoting movement between its open and closed positions via a pivotable mounting arrangement interposed between the access cover and the peripheral wall.

* * * * *